US005626440A

United States Patent [19]

Greene, Jr. et al.

[11] Patent Number: 5,626,440

[45] Date of Patent: May 6, 1997

[54] RETRACTABLE BEACH STAIRWAY

[76] Inventors: G. Nash Greene, Jr., 914 Ocean Blvd. West; Donald M. Campbell, 117 Seaside Dr., both of Holden Beach, N.C. 28462

[21] Appl. No.: 389,493

[22] Filed: Feb. 16, 1995

[51] Int. Cl.[6] ..... E02B 3/20

[52] U.S. Cl. ..... 405/218; 182/88

[58] Field of Search ..... 405/218, 220; 182/88, 98, 115, 127

[56] References Cited

U.S. PATENT DOCUMENTS

| | | | |
|---|---|---|---|
| 3,469,654 | 9/1969 | Dohrman | 182/88 |
| 3,686,876 | 8/1972 | Muschell . | |
| 3,953,980 | 5/1976 | Bennett . | |
| 3,999,397 | 12/1976 | Albery . | |
| 4,008,506 | 2/1977 | Smith . | |
| 4,107,932 | 8/1978 | Cantrell . | |
| 4,123,912 | 11/1978 | Meldrum . | |
| 4,352,597 | 10/1982 | Kay . | |
| 4,398,849 | 8/1983 | Moran et al. | 405/218 X |
| 4,896,744 | 1/1990 | Crone | 182/88 |
| 5,025,891 | 6/1991 | Naka et al. | 182/88 X |
| 5,228,707 | 7/1993 | Yoder | 182/88 X |
| 5,333,557 | 8/1994 | Eickhoff | 405/218 X |

FOREIGN PATENT DOCUMENTS

| | | | |
|---|---|---|---|
| 176399 | 8/1961 | Sweden | 182/88 |

*Primary Examiner*—William P. Neuder
*Attorney, Agent, or Firm*—Rhodes, Coats & Bennett

[57] ABSTRACT

A stairway for providing access over a dune to a beach, while being retractable to avoid damage from adverse weather conditions, the stairway being adapted to be mounted on a plurality of piling on a dune, the stairway comprising a pivotally mounted housing section having an upper surface suitable for use as a walkway and a cavity beneath the walkway; a stair section moveable between a retracted position within the housing section cavity and an extended position, wherein the stair section extends from the housing section to the beach at an angle of about 45° below horizontal; and drive means adapted to move the stair section between retracted and extended positions.

18 Claims, 3 Drawing Sheets

RETRACTABLE BEACH STAIRWAY

BACKGROUND OF THE INVENTION

The present invention relates to a stairway for providing access to a beach, or other land area immediately adjacent a body of water, and in particular to a stairway which can be retracted or removed to avoid damage due to water or weather conditions.

In many areas, a person desiring access to a beach must climb over berms or dunes, which are frequently at a height several feet above the beach level, rendering access difficult. In these instances, piers or walkways are normally built over the berm or dune area. Since the outer end of the walkway, i.e., the end of the walkway closest to the beach, is generally several feet above the beach, a stairway is also constructed from the end of the walkway down to the beach. The distal end of the stairway, i.e., the end of the stairway closest to the beach, will normally extend into the beach surface.

Unfortunately, the topographical configuration of a beach does not remain static. The effect of tides and other water movement, as well as wind action, causes frequent and often dramatic shifting in the water location and level, the shore line, and the level of beach sand at a given location. Thus, a beach stairway suitably positioned at one time may be unsuitably positioned at another time. Also, changing conditions, particularly water movement, frequently results in damage to these stairways and walkways, necessitating their periodic repair or replacement.

Various portable or removable pier or dock structures have been described in the prior art as exemplified by the following patents:

| | |
|---|---|
| 3,686,876 | Munchell |
| 3,999,397 | Albery |
| 4,008,506 | Smith |
| 4,107,932 | Cantrell |
| 4,123,912 | Meldrum |
| 4,352,597 | Kay |

While the constructions of some of the structures described in the above patents includes hinged sections, none of the structures described provide a safely usable stairway, which is readily retractable or removable when needed. Moreover, none of the cited references describe a stairway of this nature meeting building codes for structures of this type.

Accordingly, there still remains a need for a stairway structure permitting ready access from walkways extending over berms or dunes and the like down to a beach at a lower level. In particular, there is a need for a walkway including a retractable stair section that can be readily withdrawn or deployed as conditions and needs dictate, and stored in a manner which will still allow utilization of the walkway section.

SUMMARY OF THE INVENTION

The present invention provides an improved structure for accessing a beach or other shoreline from an elevated level, e.g., the top of a dune adjacent the shore line. The structure described herein is comprised of a horizontal housing section, which also serves as a walkway, and a stair section movable between a retracted position and an extended position. The structure may also include a drive means for moving the stair section between the retracted and extended positions. The structure of the present invention is supported on a foundation, e.g., pilings positioned in the dune. In the preferred embodiment, the structure is pivotally attached to the support pilings to facilitate extension and retraction of the stair section, as well as removal of the entire stairway if appropriate. The structure may also include handrails detachably secured to the housing section and/or the stair section.

Now looking at the structure in greater detail, the homing section is comprised of a top wall having an upper surface, a lower surface, parallel side edges, a rear edge and a front edge; side walls extending downwardly from the top wall, the side walls having upper edges integral with the side edges of the top wall and lower edges parallel to the top edges; and a lower wall extending at least partly beneath the top wall between the side walls. The side walls and lower walls also include rear and front edges. Together, the walls of the housing section form an interior storage cavity beneath the top wall and upper surface of the housing section, adapted to receive the stair section in the retracted position for storage when not in use. Storage of the stair section within the housing section also facilitates removal and transportation of the entire stairway.

The stair section is comprised of a plurality of adjacent steps, each step having a tread and a riser, and a pair of parallel side rails supporting the ends of the steps. For reasons which will become apparent hereinafter, the side rails preferably have a length no greater than the length of the housing section and a width less than the width of the side walls of the housing section.

In the basic construction contemplated by the present invention, the stair section can be manually pushed into the retracted position, or pulled outwardly to the extended position. Weather conditions or the physical limitations of the user, however, may make it difficult or impossible to move the stair section of the structure between the two positions without assistance. Accordingly, the structure in the preferred embodiment also includes a control or drive means for aiding in the movement of the stair section. The control means is attached to the stair section, preferably at the rear end of the stair section and serves to pull the stair section into the housing section cavity, or pull the stair section out of the housing section cavity and to the extended position. Preferably, the control means is comprised of a cable attached to the stair section and a winch for retracting or extending the cable as appropriate. The winch may be tamed manually, or powered by a drive means, e.g., an electric motor. The electric motor may be actuated by a switch manually triggered at the structure, or remotely actuated.

The structure is positioned at the desired location by detachably mounting the structure on a foundation such as a plurality of pilings positioned within the berm or dune where the structure is to be placed. Attachment is desirably in a manner permitting ease of detachment of the stairway from the foundation if relocation is necessary, e.g., when there is severe beach erosion, or where regulation permit only temporary structures.

Preferably, the structure is attached to the pilings by pivotally mounting the housing section on the pilings so that the housing section is tiltable between a horizontal position and a tilted position wherein the front end of the housing section is tilted downwardly, facilitating movement of the stair section between its retracted and extended positions. This pivotal mounting may be achieved, for example, by using a horizontal hinge having one hinged section secured to the pilings and the other hinged section secured to the bottom wall of the housing section. A locking mechanism may be used to secure the housing section in a locked horizontal position when the stair section is in the extended position to provide a stationary and safe walkway. A chain extending from a piling to the housing section may be used as an additional safety mechanism, and also can serve as a limiting means for controlling the extent of tilt of the housing section.

In operation, the stairway structure with the stair section housed within the cavity of the housing section is detachably mounted on the pilings or other base structure atop the dune. In the preferred embodiment, the mounting is by way of the aforesaid hinge permitting tilting of the structure. The stair section is then withdrawn from the housing section cavity until reaching the extended position. Withdrawal may be facilitated by tilting of the housing section. At the extended position, the stair section is pivoted downwardly to about 45° to engage the locking mechanism. In this position, the treads of the stairs are in the horizontal position and the distal end of the stair section is in engagement with the beach surface, perhaps extending beneath the surface of the beach. At the same time, the housing section is returned to the horizontal level and locked into place. Handrails may then be secured within receptacles on the housing section and/or the stair section to facilitate safe use. Withdrawal of the stair section from the housing section may be done manually, or by actuation of the drive mechanism.

When it is desired to retract the stair section, e.g., when rising tides or other weather conditions may cause damage to the stairway, the stair section is pivoted back into axial alignment with the housing section and inserted into the retracted position within the housing section for storage. In order to pivot the stair section, removal of sand and other accumulation from around the distal end of the stair section may be necessary. Insertion of the stair section into the housing section may be facilitated by pivoting of the housing section towards the tilted position. As in the case of extension, movement of the stair section between the two positions may be done manually, or with the assistance of a drive means such as the motor. Hand rails, if attached to the stair section, are removed prior to retraction of the stair section.

The housing and stair sections of the present structure may be formed of various materials. Preferably, however, the sections are formed of fiberglass, resulting in a sturdy, weather-resistant structure which is of relatively light weight in comparison with other materials such as wood. Metal parts of the structure are preferably formed of stainless steel to resist corrosion, particularly in salt water environments.

The physical dimensions of the structure are not critical to the invention, provided that the stair section, when in the extended position, is of sufficient length to reach from the forward end of the housing section to the beach surface. As previously noted, the length and width of the housing section top wall should be at least large enough to cover the stair section, when the stair section is in the retracted position. It is not necessary, however, that the housing section be of approximately the same length as the stair section. In fact, it is possible to use a housing section of a given length with stair sections of different lengths to meet different dune height requirements. The width of the structure is also not critical. However, many building codes require a width of at least forty-two inches. Movement of the stair section between the retracted and extended positions may be facilitated by rollers mounted on one of the sections in a position whereby the rollers will engage a surface of the other section during retraction or extension. For example, a plurality of rollers may be positioned to extend beneath the lower surface of the stair section to engage the upper surface of the housing section bottom wall. Alternatively, the rollers may be mounted on the housing section to engage a surface of the stair section.

For safety reasons, the stair section is preferably locked in the extended position by a locking mechanism that is engaged when the stair section is pivoted downwardly from alignment with the housing section. The locking mechanism is desirably disengaged when the stair section is pivoted back to alignment with the housing section. The locking mechanism may be formed of surfaces of the stair section which engage surfaces of the housing section to prevent further movement. For example, the lower surfaces of the stair section side mils may be notched to engage the bottom wall of the housing section in the extended position, while the top rear comers of the side walls may be angled to 45° to engage the lower surface of the top wall when the stair section is in the extended position. Other locking mechanisms will be readily apparent to one skilled in the art.

Thus, it is an aspect of the present invention to provide an improved retractable and detachable beach stairway comprised of a housing section including an upper surface adapted to serve as a walkway, and a stair section moveable between a retracted position beneath the upper surface of the housing section and an extended position, wherein the stair section extends downwardly from the forward end of the housing section to the beach or other lower ground surface. It is another aspect of the present invention to provide a structure having the aforesaid housing and stair sections, which further includes a drive mechanism for assisting in moving the stair section between the retracted position and its extended position. It is still a further aspect of the present invention to provide a structure having the aforesaid housing and stair sections in which the housing section is tiltably mounted to aid in movement of the stair section between the retracted and extended positions. These and other aspects of the present invention will be apparent to one skilled in the art upon a reading of the following detailed description of the preferred embodiment taken together with the drawings.

DETAILED DESCRIPTION OF THE PREFERRED EMBODIMENT

Figures 1, 2:
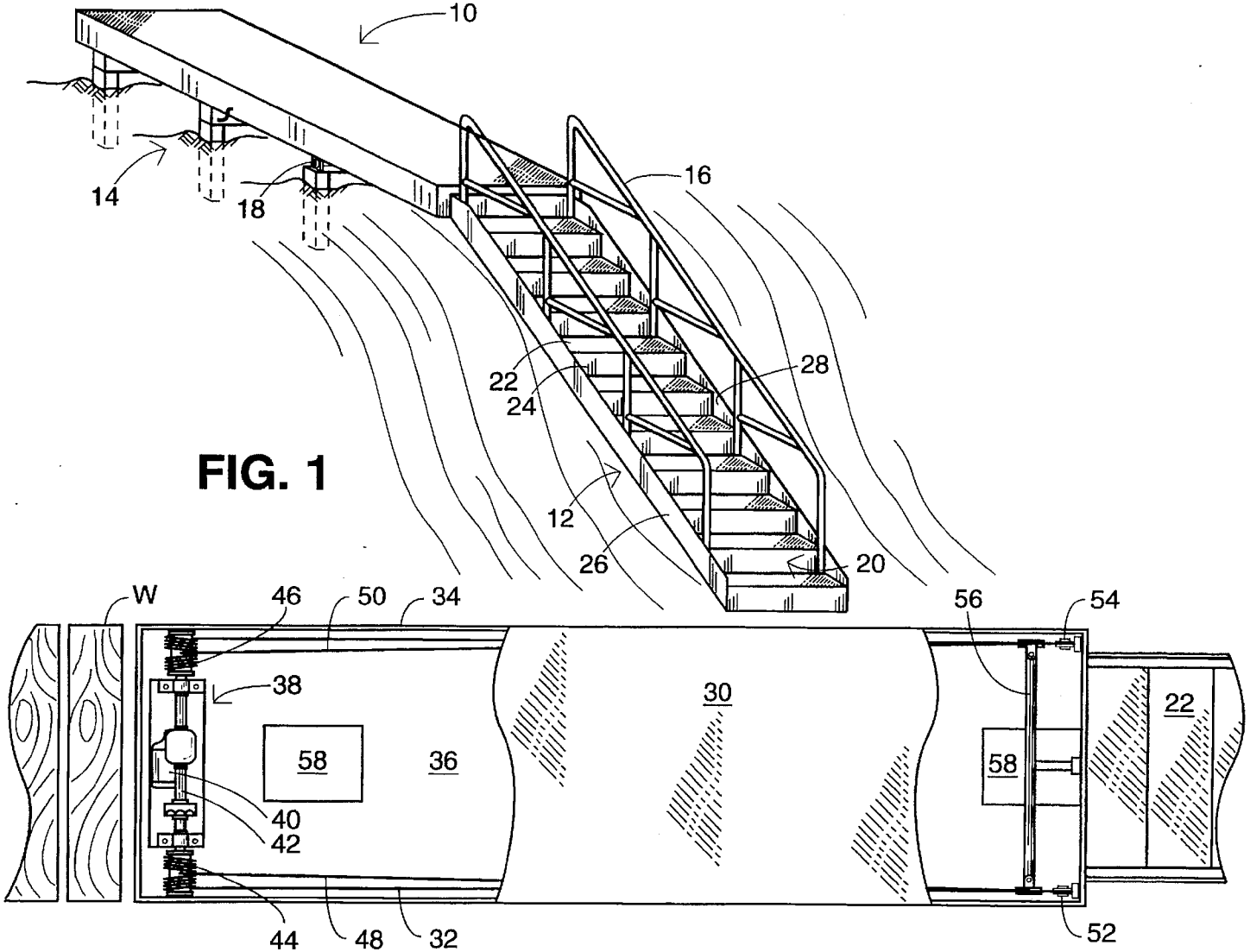
FIG. 1 is a perspective view of the beach stairway mounted in position on a dune with the stair section extending downwardly to a beach.
FIG. 2 is a top view of the housing section and a part of the stair section of the present invention with parts of the top wall of the homing section removed to illustrate interior components.

In the following description, like reference characters designate like or corresponding parts throughout the several views. Also in the following description, it is to be understood that such terms as forward, rearward, left, right, upwardly, downwardly, horizontal, upright, vertical, above, below, beneath, and the like, are used solely for the purpose of clarity in illustrating the invention, and should not be taken as words of limitations.

As shown in FIGS. 1–5, the apparatus or structure of the present invention is comprised of a housing section, generally 10, and a stair section, generally 12. Housing section 10 is supported on pilings, generally 14. Handrails 16, may be mounted on stair section 12.

For reasons to be described hereinafter, housing section 10 is preferably detachably secured to the forward piling with a horizontal hinge 18, to permit pivoting of housing section 10. Housing section 10, which is preferably formed of fiberglass, is in a box-like configuration with an open forward end. Specifically, housing section 10 is comprised of a top wall 30, side walls 32 and 34 extending downwardly from the side edges of top wall 30 and a bottom wall 36 spaced below top wall 30 and connecting side walls 32 and 34. The upper surface of top wall 30, which serves as a walkway, preferably has a non-skid surface which may be molded into top 30, or added as a covering.

A drive means 38, is positioned in the rear of housing section 10 and comprises a motor 40, adapted to turn a drive shaft 42, having winches 44 and 46 at its outer ends. Cables 48 and 50, which are preferably formed of stainless steel, extend around winches 44 and 46, respectively, and toward the front of housing section 10 where they extend around pulleys 52 and 54, respectively, and back to winches 44 and 46. Stair section 22 is attached to cables 48 and 50 by mounting bracket 56. An access panel 58 is provided in bottom wall 36 to aid in access to drive means 38.

Pilings 14 are comprised of horizontal members 60 and vertical members 62, with housing section 10 resting on horizontal members 60, except for the forward piling where housing section 10 is joined to the piling with hinge 18. When resting on the pilings, housing section 10 is secured in place with a lock 64 and a safety chain 66.

Stair section 12 is provided with a plurality of rollers 68 extending outwardly below stair section 12 for engagement with the upper surface of bottom wall 36 of housing section 10 when stair section 12 is moved between the retracted and extended positions.

Figure 6:
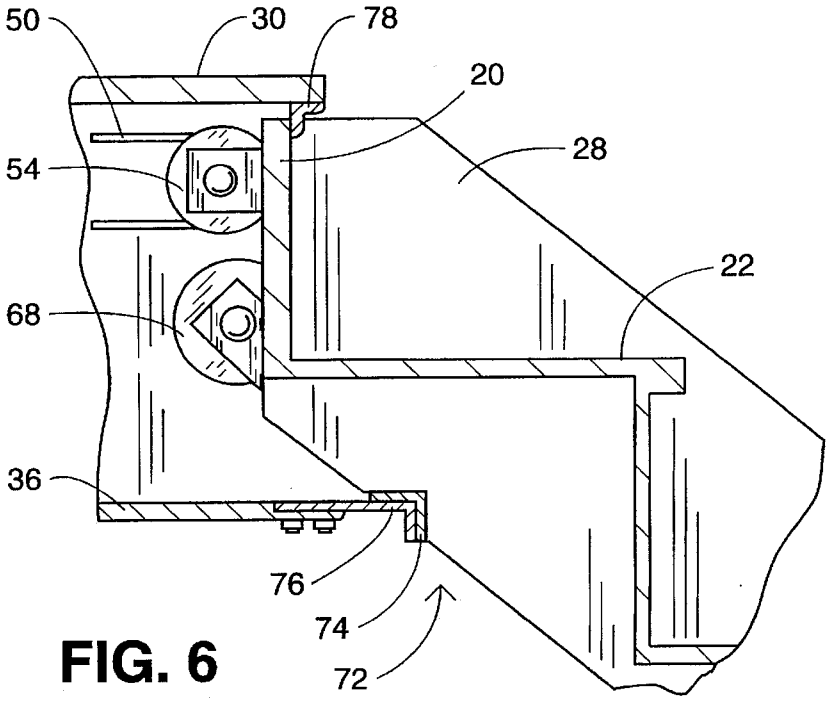
FIG. 6 is a detailed view of the locking mechanism engaged with the stair section in the extended position.

As shown in detail in FIG. 6, a locking mechanism is provided for locking stair section 12 in place in relation to housing section 10 when stair section 12 is in the extended position. This locking mechanism comprises a latch, generally 72, comprised of a notch 74 to engage end plate 76 mounted on the front edge of bottom wall 36. Riser 20 also engages a stop 78, limiting downward rotation of stair section 12.

Figure 3:
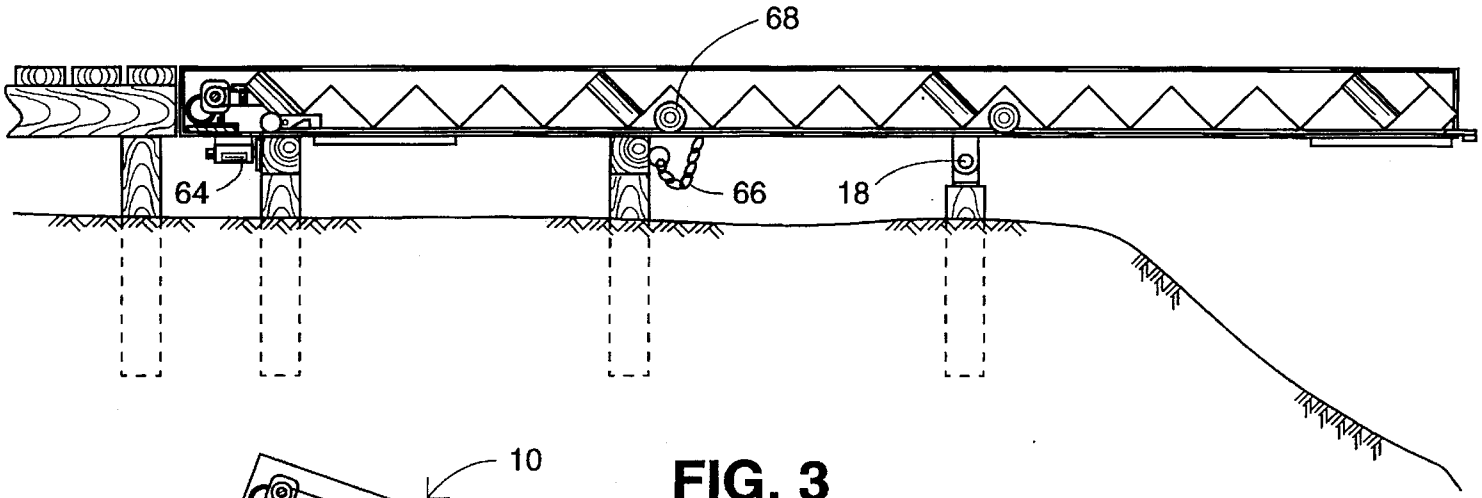
FIG. 3 is a sectional side view of the apparatus taken along the center line of the structure with the stair section in the retracted position.
Figure 4:
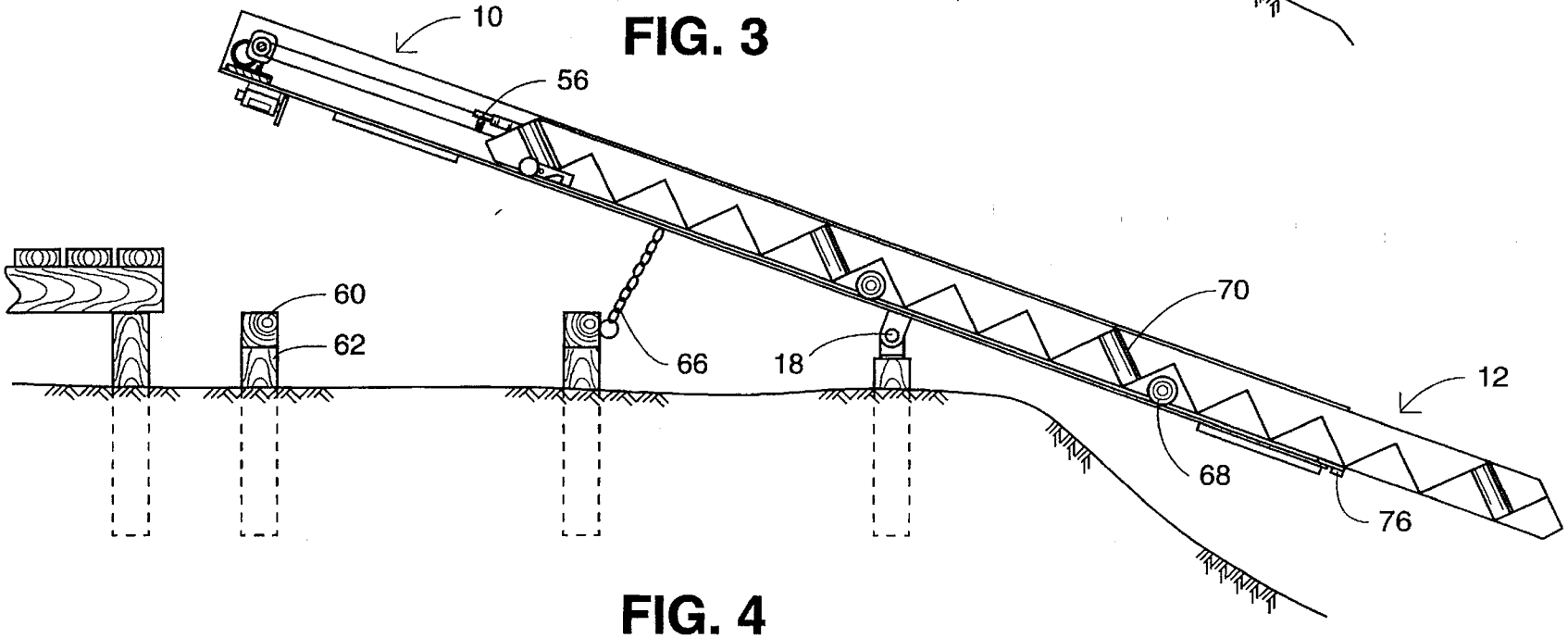
FIG. 4 is a sectional side view of the structure illustrating the stair section in an intermediate position between the retracted and extended positions.

In operation, the structure with stair section 12 in the retracted position beneath top wall 30 of housing section 10 is placed horizontally atop pilings 14 and detachably secured with pivot hinge 18. If the structure is to be maintained in this configuration, housing section 10 is also locked to piling 14 with lock 64 and secured with limit chain 66. The configuration shown in FIG. 3 is also the configuration of the structure after retracting stair section 12 from a deployed position as shown in FIG. 5.

When stair section 12 is to be deployed, lock 64 is unlocked and housing section 10 is tilted downwardly at its forward end by pivoting the structure about hinge 18, normally until limit chain 66 is fully extended. In this position, stair section 12 is easily slid outward from housing section 10, particularly with the aid of rollers 68. In the basic structure contemplated by the present invention, the outward movement of stair section 12 can be achieved by gravity, or by simply pulling on stair section 12. Stair section 12 can also be deployed in a controlled manner using drive means 38. When using drive means 38, motor 40 rams shaft 42 to rotate winches 44 and 46 winding continuous cables 48 and 50, respectively, about pulleys 52 and 54. As illustrated, winches 44 and 46 turn in a clockwise manner carrying attachment bracket 56 forward to move stair section 12 outwardly. When stair section 12 is fully deployed, housing section 10 is pivoted about hinge 18 back to a horizontal position on pilings 14 and locked in place by engaging lock 64. Stair section 12 is pivoted downwardly in relation to housing section 10 to an angle of approximately 45°, so that treads 22, which also have non-slip surfaces, are horizontal. Upon rotation of stair section 12 to this position, notch 34 on side rail 28 and a corresponding notch, not shown, on side rail 26 engage end plate 76. Also, top riser 20 engages stop 78.

Figure 5:
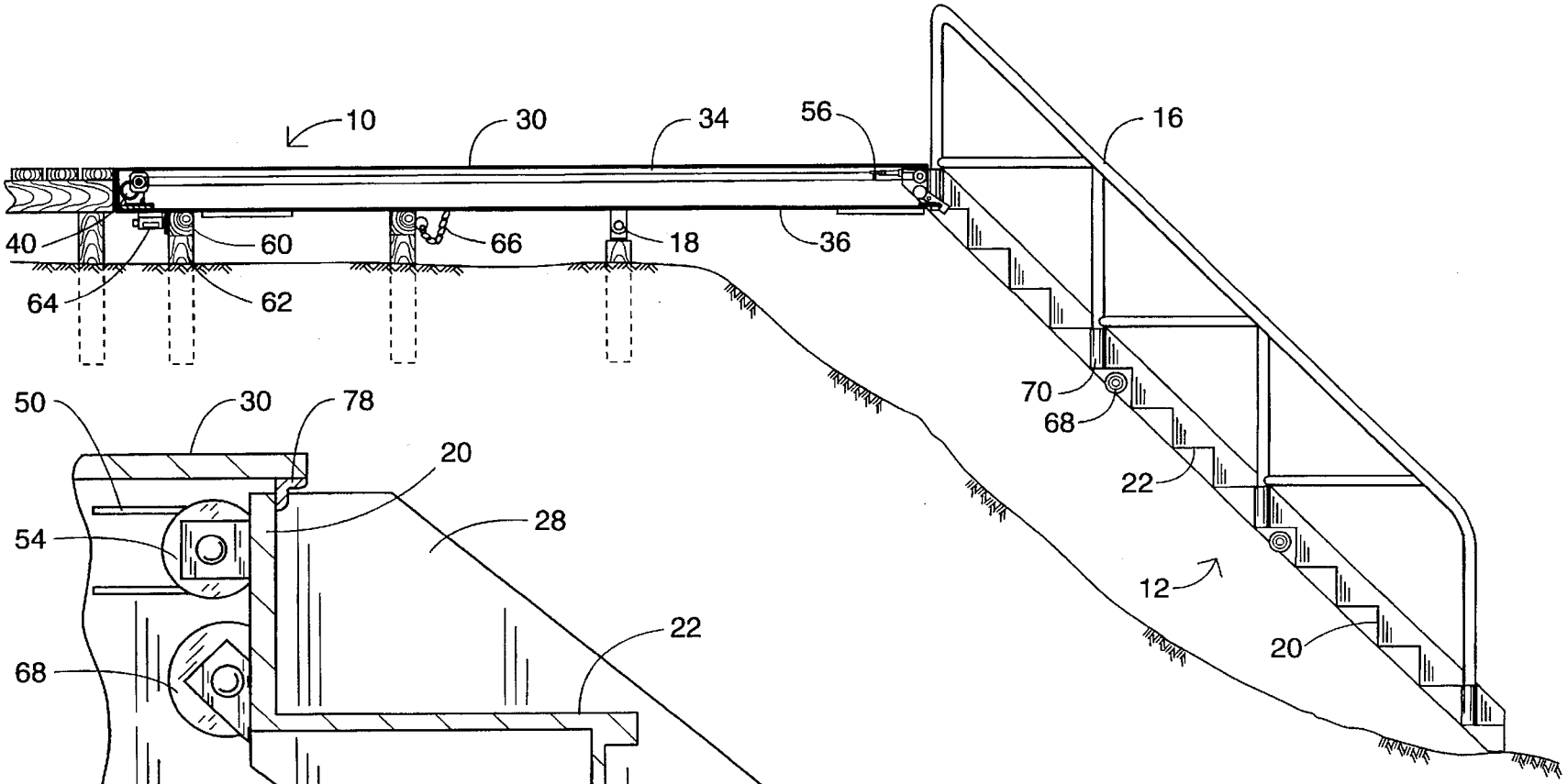
FIG. 5 is a sectional side view showing the structure with the stair section in the extended position.

The structure of the present invention will normally remain in the configuration shown in FIG. 5 so that the user can walk along top wall 30 of housing section 10 and stair section 12 to travel between dune D and the beach B.

When retraction of stair section 12 is desired, the procedure previously described is reversed. Lock 64 is then unlocked so that housing section 10 can be pivoted about hinge 18 downwardly at its front end. Stair section 12 is rotated into axial alignment with homing section 10 to disengage latch 72. Stair section 12 can then be moved to its retracted position, either manually or with drive means 38. If drive means 38 is used, motor 40 is reversed to turn winches 44 and 46 in a counter-clockwise direction as illustrated. Stair section 12 is then carded by bracket 56 and cables 48 and 50 into the interior cavity of housing section 10 until the configuration shown in FIG. 3 is reached.

Certain modifications and improvements will occur to those skilled in the art upon a reading of the foregoing description. For example, a plurality of housing sections can be used in an end-to-end configuration to form a walkway. It should be understood that all such modifications and improvements have been deleted herein for the sake of conciseness and readability but are properly within the scope of the following claims.

What is claimed is:

1. A retractable stairway comprising a) a housing section having a top wall with an upper surface suitable for use as a walkway and a cavity beneath said top wall;

b) a stair section moveable between a retracted position within said cavity and an extended position and;

c) pivotal mount beneath said housing section, said housing section being pivotal on said mount between a horizontal position and a tilted position.

2. The stairway of claim 1 in which said housing section comprises a top wall including said upper surface, side walls extending downwardly from said top wall, and a bottom wall spaced beneath said top wall and extending between said side walls, said walls together forming a cavity into which said stair section is stored when in the retracted position.

3. The stairway of claim 1, further including detachable handrails.

4. The stairway of claim 1, including a plurality of steps, each step having a tread portion and a riser portion, said tread portion being substantially horizontal when said stair section is in the extended position.

5. The stairway of claim 1, further including a latch member securing said stair section in position when said stair section is in the extended position.

6. The stairway of claim 1, wherein said stair section includes rollers positioned to engage a wall of said housing section when said stair section is moved between said retracted and extended positions.

7. The stairway of claim 1, further including a lock adapted to maintain the upper surface of said housing section in a horizontal position when said stair section is in an extended position.

8. The stairway of claim 1, wherein said stair section includes brackets for detachably holding handrails on said stair section.

9. The stairway of claim 1, further including a drive means for moving said stair section between its retracted and extended positions.

10. An outdoor stairway leading from an upper level to a lower level comprising a) a stairway support of pilings extending upwardly from said upper level;

b) a housing section positioned on said support, said housing section having a top wall with an upper surface suitable for use as a walkway and a cavity beneath said top wall; and c) a stair section moveable between a retracted position within said housing section cavity and an extended position, wherein said stair section extends from said housing section to said lower level.

11. The stairway of claim 10, wherein said housing section is pivotally attached to said support, said housing section being moveable between a horizontal position and a tilted position.

12. The stairway of claim 10, further including drive means within said housing section and in communication with said stair section, said drive means being adapted to move said stair means between retracted and extended positions.

13. The stairway of claim 11, wherein said stair section is horizontal when in the retracted position and at an angle of about 45° from horizontal in the extended position.

14. The stairway of claim 11, further including handrails.

15. The stairway of claim 11, wherein said housing section includes a support surface to support said stair section in the retracted position, and said stair section includes rollers engaging said support surface when said stair section is moved between the retracted position and the extended position.

16. The stairway of claim 11, wherein said housing section and said stair section are made of fiberglass.

17. The stairway of claim 11, wherein said upper level is the top of a dune and said lower level is a beach.

18. A stairway for providing access over a dune to a beach, while being retractable to avoid damage from adverse weather conditions comprising a) a plurality of piling extending upward from said dune, said pilings including a front piling and a rear piling;

b) a housing section pivotally mounted on said front piling, said housing section including a top wall having an upper surface suitable for use as a walkway and a cavity beneath said top wall, said housing section being pivotal between a horizontal position and a tilted position;

c) a stair section moveable between a retracted position within said housing section cavity and an extended position, wherein said stair section extends from said housing section to said beach at an angle of about 45° below horizontal; and d) drive means within said housing section, said drive means being adapted to move said stair section between retracted and extended positions.

* * * * *